US005083492A

United States Patent [19]

Gorr

[11] Patent Number: 5,083,492

[45] Date of Patent: Jan. 28, 1992

[54] GUITAR TREMOLO SYSTEM

[76] Inventor: Joachim Gorr, Auguste-Viktoria-Strabe 31, D-1000, Berlin, Fed. Rep. of Germany

[21] Appl. No.: 559,251

[22] Filed: Jul. 30, 1990

[30] Foreign Application Priority Data

Oct. 4, 1989 [JP] Japan ..... 1-259464

[51] Int. Cl.[5] ..... G10D 3/00

[52] U.S. Cl. ..... 84/313

[58] Field of Search ..... 84/313

[56] References Cited

U.S. PATENT DOCUMENTS

| | | | |
|---|---|---|---|
| 4,171,661 | 10/1979 | Rose | 84/313 |
| 4,782,732 | 11/1988 | Kato et al. | 84/313 |
| 4,787,285 | 11/1988 | Goto | 84/313 |
| 4,864,909 | 9/1989 | Toney | 84/313 |
| 4,944,208 | 7/1990 | Kusek | 84/313 |

FOREIGN PATENT DOCUMENTS

3309217 A1 9/1983 Fed. Rep. of Germany .

*Primary Examiner*—Blair W. Brown

*Attorney, Agent, or Firm*—Limbach, Limbach & Sutton

[57] ABSTRACT

The invention relates to a guitar tremolo system, a tremolo unit being received in a recess in the body of the guitar, a base block which has string riders being maintained with provision for horizontal pivoting and balanced by tension springs. Multi-subdivided base blocks (5) are disposed in a vertically adjustable mounting frame (1) having bearings for tremolo pivot pin (2) around which a base block actuator (3) and the various base blocks (5) are mounted for rotation. Also the base blocks (5) are securable at choice to the underside of the actuator (3) and are connected to individually operating tension springs (13).

8 Claims, 3 Drawing Sheets

GUITAR TREMOLO SYSTEM

The invention relates to a guitar tremolo system. Tremolo systems of this kind are known, for example, from U.S. Pat. No. 4,171,661 and DE-OS-3 309 217.

All the conventional tremolo systems use just a single base block to receive all six strings of the guitar. Consequently, when the tremolo system is actuated all six strings are tensioned and detensioned. It is therefore impossible to strike a free string and allow the sound to decay while the tremolo is being operated. More particularly in American country and western music guitarists often want a tremolo effect only for one or two strings in order to achieve a Hawaii effect. When string bending is used with a tremolo system having only one base block the complete system is bound to go out of tune since spring tension is increased by pulling the string in a manner and cannot be compensated for by the spring tension. It is the object of the invention so to device the known tremolo system that the tremolo effect can be provided for just one or two strings.

The problem is solved according to the invention by the means set out in claim 1. The invention therefore solves the problems referred to. Also, completely novel playing techniques and effects can be devised by means of this multifunction tremolo system.

Developments of the invention are set out in the subclaims.

The invention will be described in greater detail hereinafter with reference to an embodiment of the subject of the invention shown in the drawings wherein.

Figure 1:
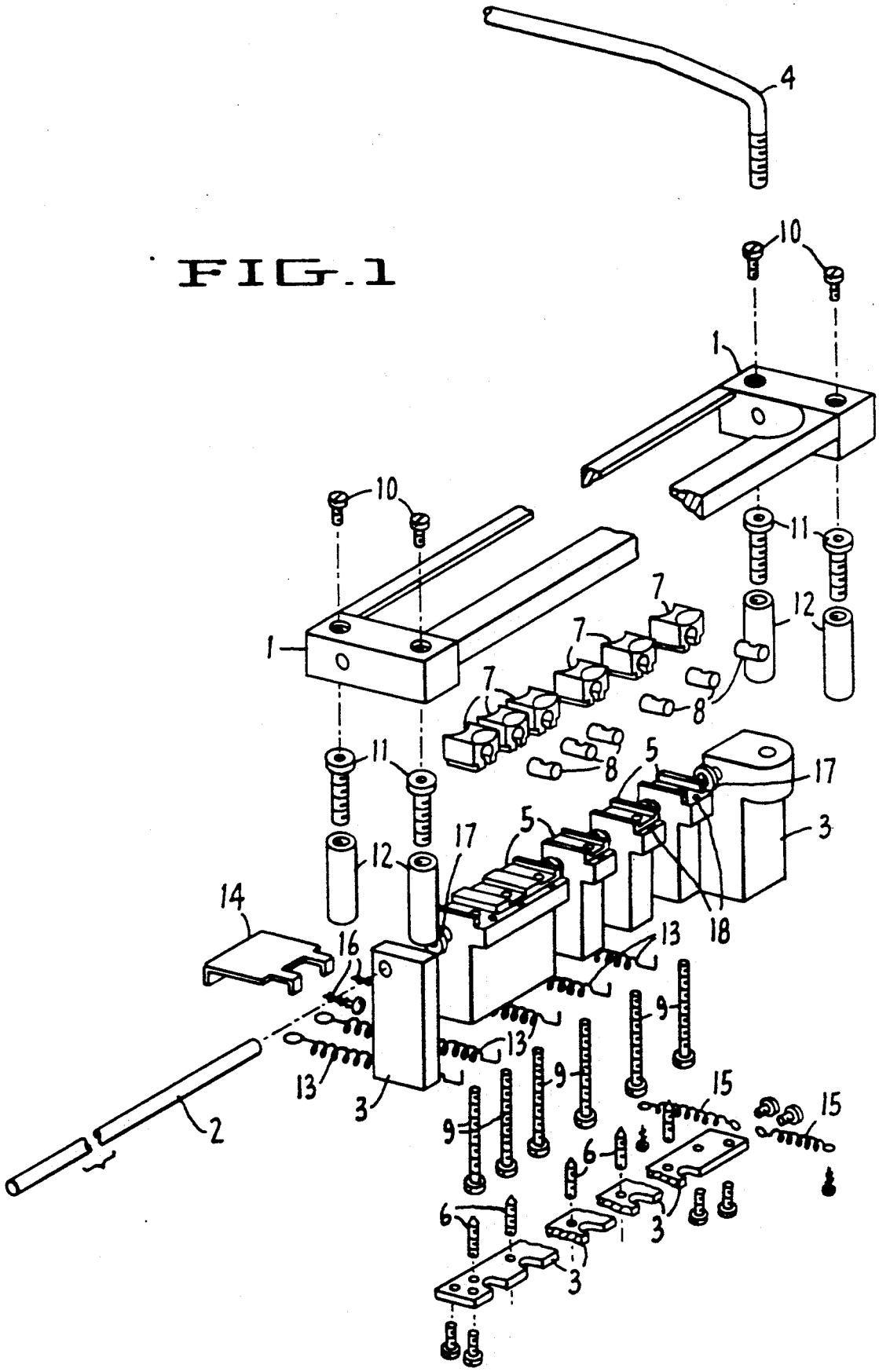
FIG. 1 is a fragmented overview of the components of the novel tremolo system.
Figure 2:
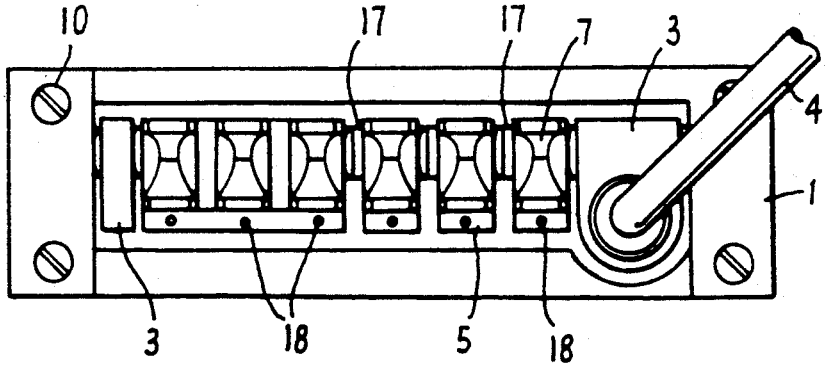
FIG. 2 is a partial plan view of the tremolo unit.
Figure 3:
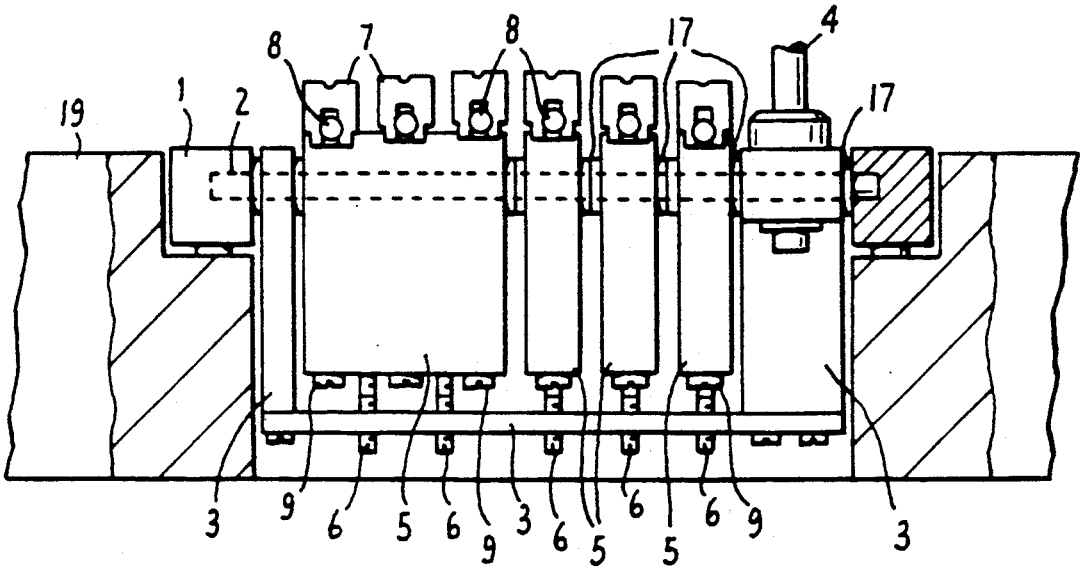
FIG. 3 is a rear view corresponding to FIG. 2 with a recess in the guitar body.
Figure 4:
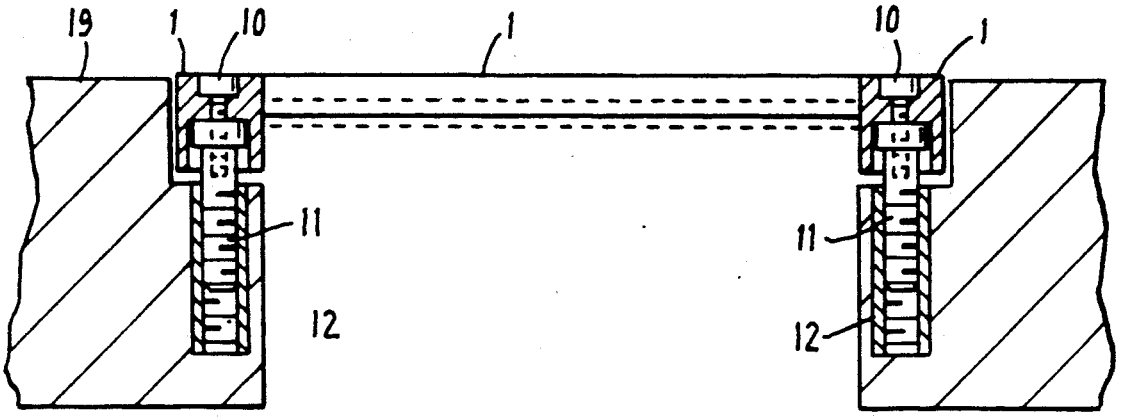
FIG. 4 is a partial longitudinal section through the rear part of FIG. 2.
Figure 5:
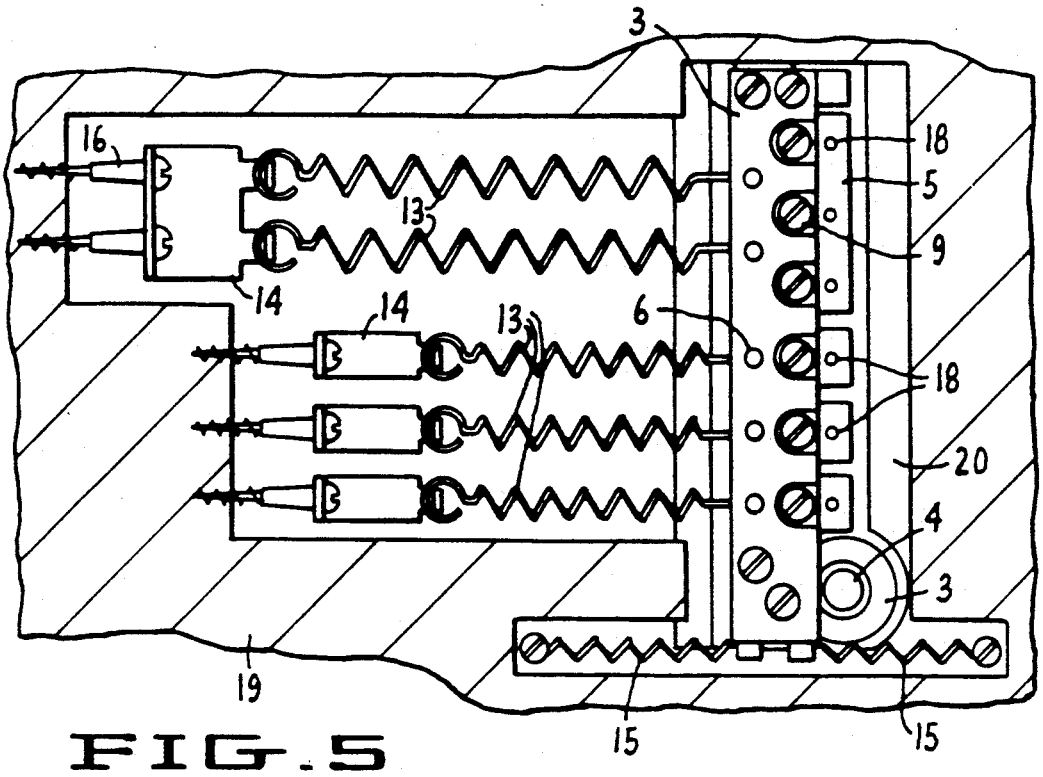
FIG. 5 is an inverted plan view of the tremolo block with the spring tensioning device.
Figure 6:
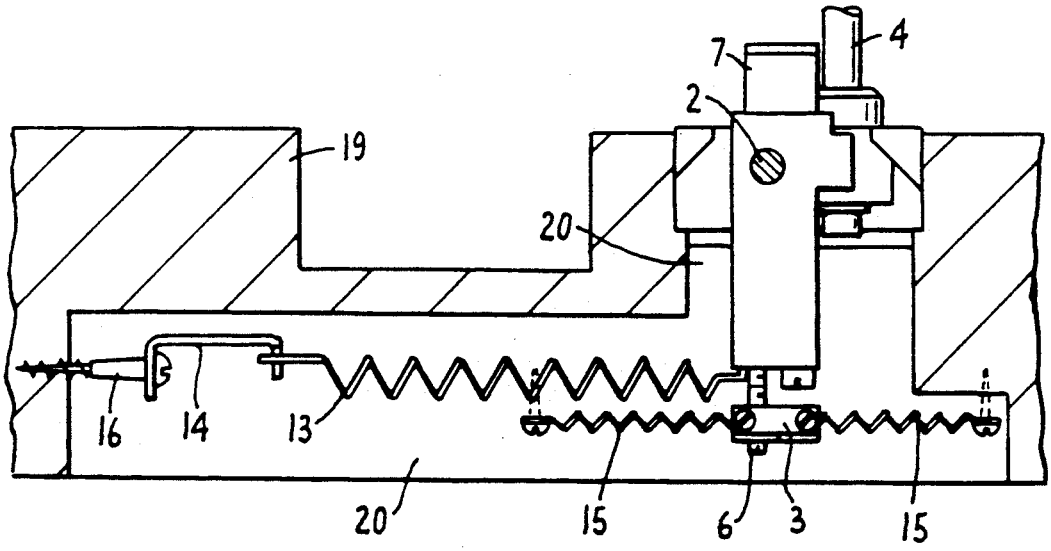
FIG. 6 is a side view corresponding to FIG. 5 with a recess in the guitar body.

The guitar is of conventional kind and has a headstock, where the machine heads are disposed, a neck with fingerboard and a body 19, a vertically adjustable mounting frame 1 for the tremolo system being received in a recess 20 in body 19. In the plan view the frame 1 can be seen to have four lockscrews 10 which engage in four bores; the same and the screws 10 serve to secure the vertical adjustment screws 11 which are disposed below them, serve for vertical positioning of the complete system and are secured in screwthreaded liners 12. Consequently, the frame 1 forms a rigid unit with the body 19 and all the tensions and torques which arise during operation of the tremolo can be absorbed. To make a vertical adjustment the screws 10 are slackened and by means of an appropriate key or spanner or the like the screws 11 can be adjusted through the bore.

Figure 7:
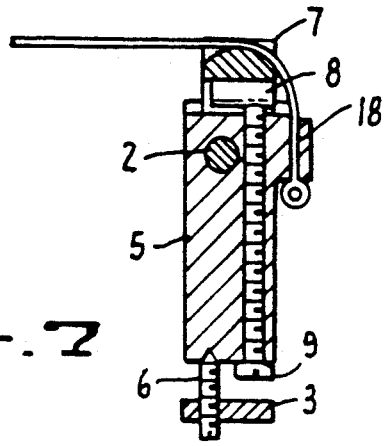
FIG. 7 is a vertical cross-section through a base block with string tensioner and fixing device.

The rectangular frame 1 has on both side bearings for a tremolo pivot pin 2 around which there move, with the interposition of rubbing or spacer plates 17, a base block actuator 3 and independently arranged base blocks 5. The centre of the pivot pin 2 axis is positioned substantially ideally below the point of contact between the strings and the string riders 7; consequently, and as can be gathered more particularly from FIG. 7, the string position—i.e., the distance between the top edge of the fret and the strings—cannot be varied more particularly when the strings are pulled. The base blocks 5, which are movable independently of one another in accordance with the invention, are each formed with a bore to receive the spindle 2. Saddle screws 8 having a transverse screwthreading are effective to enable the riders 7 to be rigidly connected by screws 9 to the associated block 5; the screws 9 extend through bores in the block 5 into the saddle screws 8. More information can be gathered more particularly from FIG. 7.

The part 3 is also formed with bores to receive the pivot pin 2. Two stabilizing springs 15 which are effective in their spring tension in the direction of the rotation but which oppose one another engage the underside of the part 3 and are effective to maintain the part 3 in a stable position independently of the position of a tremolo arm 4. Consequently, the weight of the tremolo arm 4, which is anchored in the part 3, is compensated for independently of arm position and so fixing pins can at any time be engaged in corresponding recesses in the undersides of the blocks 5 at choice without such engagement detuning the springs thus engaged.

The necessary spring tension is exerted separately in the direction of rotation on each of the various blocks 5 by means of the springs 13. The pulling of a string on the fingerboard therefore does not affect the other blocks 5. The springs 13 are disposed individually at the base block ends remote from the pivot pin 2 and are rigidly connected to the body 19 by means of a retaining bracket 14 and a wood screw 16.

The tremolo system described makes it possible for the first time to pull individual strings by means of the tremolo arm 4 and the engageable pins by way of the subdivided base blocks 5 in order to open up new playing techniques for guitarists.

I claim:

1. A guitar, comprising:

(a) a body having a recess formed therein;

(b) a tremolo unit mounted in the recess of the body;

(c) a neck extending from the body and having a fingerboard formed as a part thereof;

(d) a plurality of strings, each string connected at one end to the neck so as to extend across the fingerboard and connect to the body;

the tremolo unit including a subdivided base block unit comprising a plurality of independently operable tremolo base blocks, each base block having a corresponding string attached thereto, the base block including string rider means connected to the base blocks for horizontal pivoting and balance by tension springs, the base blocks being disposed in a vertically adjustable mounting frame having bearings connected thereto for receiving a tremolo pivot pin around which a base block actuator and the base blocks are mounted for rotation, the base blocks being individually selectively securable to the actuator and connected to individually operating tension spring whereby for vertical adjustability of the mounting frame, the underside of the mounting frame is formed with a plurality of recesses formed therein for receiving height adjustment screws which are screwed into liner means disposed in the body and which are secured by locking means disposed through the frame into the heads of the adjustment screws.

2. A guitar as in claim 1 and further including fixing pins provided on the underside of the base block actuator and selectively engageable in corresponding recesses in the base blocks.

3. A guitar as in claim 1 or 2 and further including spacer disks disposed between the base blocks and between said base blocks and the actuator.

4. A guitar as in claim 1 wherein the actuator is U-shaped to define first and second actuator arms and wherein a tremolo arm is secured to the first activator arm.

5. A guitar as in claim 4 and further including two oppositely-acting stabilizing springs disposed on the actuator.

6. A guitar as in claim 15 wherein the base blocks are formed to include continuous boxes for the strings.

7. A guitar as in claim 6 wherein string riders are secured to corresponding base blocks by saddle screws and clamping screws.

8. A guitar as in claim 1 wherein the tension springs are provided on the base blocks on bottom ends opposite to the pivot pin and are secured by a retaining bracket and a wood screw in the body.

* * * * *